United States Patent [19]

Snyder et al.

[11] 4,311,319

[45] Jan. 19, 1982

[54] ROLLER SKATE

[75] Inventors: Charles W. Snyder, Dayton; Shirley S. Weaver, Vandalia, both of Ohio

[73] Assignee: Snyder Skate Co., Inc., Dayton, Ohio

[21] Appl. No.: 179,247

[22] Filed: Aug. 18, 1980

[51] Int. Cl.[3] ..... A63C 17/02

[52] U.S. Cl. ..... 280/11.28; 411/136; 411/143; 411/150; 411/161

[58] Field of Search ..... 280/11.28, 11.27; 151/40, 39, 34, 67, 41.5

[56] References Cited

U.S. PATENT DOCUMENTS

| | | | |
|---|---|---|---|
| 827,562 | 7/1906 | Pollack et al. | 151/41.5 |
| 1,244,039 | 10/1917 | Droll | 151/41.5 |
| 1,349,491 | 8/1920 | Burton | 151/41.5 |
| 2,510,722 | 6/1950 | Snyder | 280/11.28 |
| 2,606,768 | 8/1952 | Wagner | 280/11.28 |
| 2,689,743 | 9/1954 | Ware | 280/11.28 |
| 3,024,033 | 3/1962 | Skaggs | 280/11.28 |
| 3,377,079 | 4/1968 | Barczak | 280/11.28 |
| 4,047,725 | 9/1977 | Pinchock | 280/11.28 |
| 4,071,256 | 1/1978 | Kimmell | 280/11.28 |
| 4,194,752 | 3/1980 | Tilch et al. | 280/11.28 |

*Primary Examiner*—Joseph F. Peters, Jr.
*Assistant Examiner*—Michael Mar
*Attorney, Agent, or Firm*—Reuben Wolk

[57] ABSTRACT

A roller skate having a wheel support assembly which provides a single device for adjusting the compression within the assembly. The adjustment is accomplished by a cap at the lower end of the assembly which can be rotated to apply the required compression, without the need to loosen any other part of the mechanism. The cap is locked in place after rotation, and is indexed to permit the repeated positioning of the cap.

4 Claims, 5 Drawing Figures

ROLLER SKATE

BACKGROUND OF THE INVENTION

Roller skates have provided recreation and sport for many years, and as the popularity of skating has increased, so has the need for improvements in the skates. This is particularly true of indoor exhibition and dance performances utilizing specially designed skates which are integrally attached to the shoe. The truly versatile skate must be capable of responding to the performer's actions, whether in dance, figure, free style, free dance, or artistic skating. These skates are designed with wheel support structures which provide a wide range of flexibility, while at the same time retaining desired support and smoothness of operation. In order to achieve these ends, it is desirable to provide a simple, efficient means for controlling the flexibility of operation of the wheels of the skate with respect to the shoe, and hence the foot, of the skater.

PRIOR ART STATEMENT

The use of adjusting means to control flexibility in roller skates is known, but such means are located within the body of the wheel support assembly, where they are more difficult to reach. In addition, all these devices require loosening and tightening of more than one portion of the assembly, such as a king bolt and a jam nut; because of this arrangement, the adjusting procedure is more complicated, more time-consuming, and less accurate. Such means are shown, for example, in the following U.S. Pat. Nos.:

Snyder: 2,510,722;
Ware: 2,689,743;
Wagner: 2,606,768;
Skaggs: 3,024,033;
Barczak: 3,377,079.

SUMMARY

It is a principal feature of the invention to provide a simple means for controlling the flexibility of the skate by the use of an adjusting device.

It is a further feature to provide such control by a simple mechanism, consisting of a single member mounted on the lowermost portion of the wheel support assembly, by which the cushions in the assembly are compressed.

It is another feature of the invention to utilize such selective compressibility to control the type of skating maneuver by the relative motion of the truck assembly, which affects the tiltability, pivotability, or "feel" of the wheel trucks.

Another feature of the invention involves means to lock one of the members in place during operation of the adjusting device, thus permitting proper adjustment.

Another feature of the invention enables the skater to adjust the mechanism without the need for moving any other part of the skate, thus accomplishing the adjustment more quickly and minimizing any adjusting errors which might arise if two or more parts needed to be alternately adjusted.

Another feature provides an indexed relationship between the locking member and the support assembly, so that the relationship can be selectively repeated.

Other details, features, and objects of the invention will become apparent from the embodiments presented in the following specification, claims and drawings.

BRIEF DESCRIPTION OF THE DRAWING

The accompaning drawing shows the preferred embodiment of the invention, in which.

DESCRIPTION OF ILLUSTRATED EMBODIMENT

Figure 1:
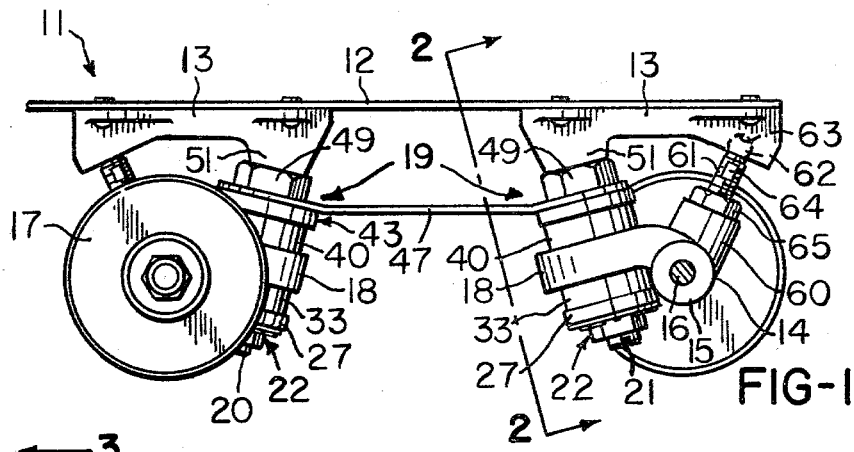
FIG. 1 is a side elevation of a skate embodying the invention, with one wheel removed for clarity.
Figure 2:
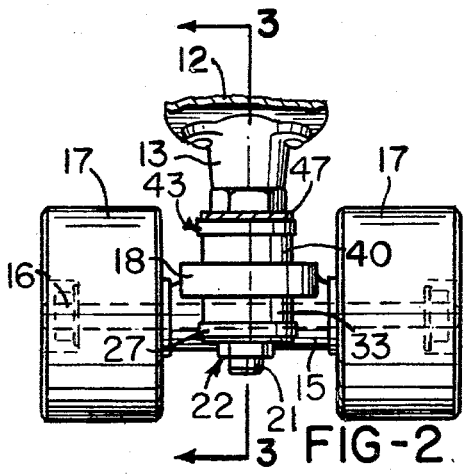
FIG. 2 is a section taken along lines 2—2 of FIG. 1.
Figure 4:
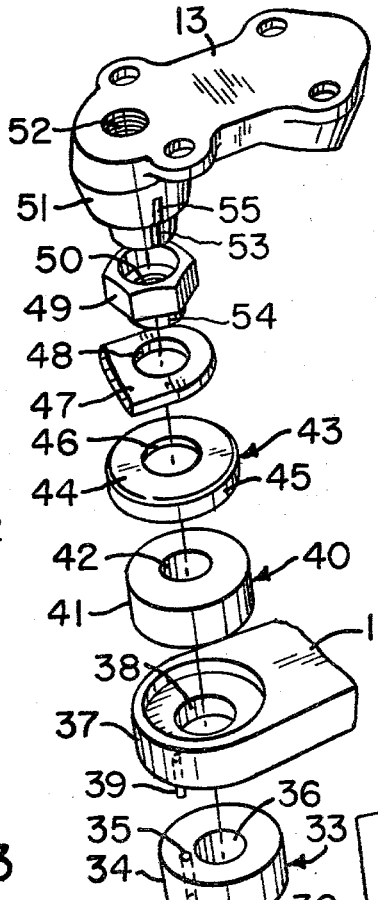
FIG. 4 is an exploded perspective view of a typical wheel support assembly embodying the invention.
Figure 3:
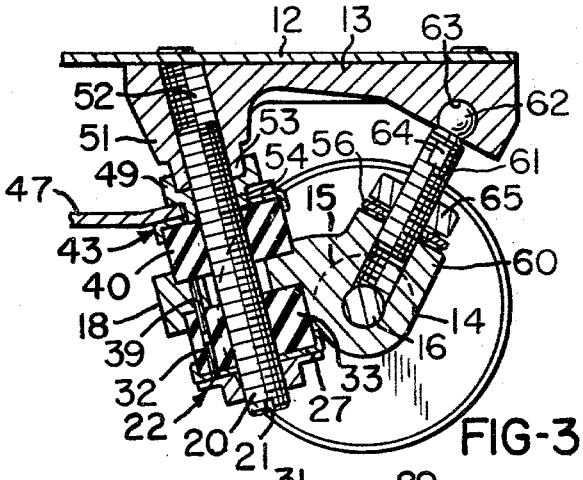
FIG. 3 is a section taken along lines 3—3 of FIG. 2.

Referring now to the drawings, a typical skate is illustrated, although it should be understood that various components may be differently constructed or arranged without departing from the spirit of the invention. The skate 11 includes a foot plate 12 which is adapted to be secured to a shoe (not shown). Hanger brackets 13, which are secured to the foot plate 12, extend downwardly from each end thereof, and provide support for the wheel trucks as well as the wheel support assemblies 19. The trucks include truck frames 14, each having a tubular portion 15 which serves as a support for axle 16. A pair of wheels or rollers 17 are mounted on each axle, the showing of FIGS. 1 to 3 illustrating the rear axle and wheels, and the front wheels and axle are the same. A forwardly extending arm 18 is rigidly secured to the tubular portion 15. The arm 18 is secured to the wheel support assembly 19, which is shown in exploded perspective in greater detail in FIG. 4.

The wheel support assembly is connected to the hanger bracket 13 by means of a threaded kingpin or bolt 20, the upper end of the kingpin being threaded into a corresponding threaded opening 52 in the inwardly extending hanger bracket boss 51. The lower end of the kingpin 20 is provided with a slot 21 to permit it to be threaded in or out, but it should be understood that the end may alternatively have a hexagonal head, such as a bolt head. The adjusting device which is the principal feature of the invention is designated as a locking cap 22, and is threaded on the lower portion of the kingpin. The cap 22 consists of a flat circular plate 23 having radially extending serrations 24. Eight of these serrations are shown, although the exact number is a matter of choice. These serrations are shown as extending downwardly to create indentations in the upper surface as a matter of convenience in stamping the plate, although this, too, is a matter of choice. A hex nut 25 is either integral with, or permanently secured to, the lower surface of plate 23. A threaded opening 26 extends through both the plate and the nut for attachment to the kingpin.

Figure 5:
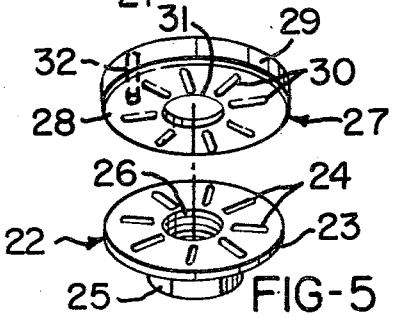
FIG. 5 is a detailed perspective view of the adjusting means, with one part rotated for clarity.

The other key part of the adjusting means is mounted on the kingpin just above the locking cap 22. This part is the lower cushion cup 27, consisting of a flat circular plate 28 having an upwardly extending wall 29 around the periphery to form a cup-shaped member. In the center of the plate is an opening 31 to allow the cup to fit over the kingpin. A plurality of radially extending serrations 30 are indented in the plate 28, to match the serrations 24 in cap 22. This relationship is also illustrated in FIG. 5. Preferably the serrations 30 extend downwardly to extend below the lower surface, thus permitting them to interlock with the serrated indentations 24 in the upper surface of cap 22. An upwardly extending elongated cylindrical pin 32 is also permanently secured to the upper surface of plate 28, for a purpose to be described below.

A lower cushion 33 is also mounted over the kingpin by means of center opening 36. The cushion body 34 is cylindrical in shape, and is made of a resilient polymeric material, such as rubber or suitable plastic, such as vinyl. The cushion is designed to fit within the upwardly extending enclosure of lower cushion cup 27, which is formed by the plate 28 and wall 29. A small diameter cylindrical opening 35 extends from the upper surface to the lower surface of the cushion and fits over the pin 35 of cushion cup 27 to lock the cushion in place. The upper end of the cushion is retained by the arm 18, more specifically by the circular boss 37 which is also cup-shaped and has a central opening 38 through which the kingpin passes. A downwardly extending elongated cylindrical pin 39 is mounted on the lower surface of boss 37 and extends downwardly into the opening 35 in cushion 33 to complete the locking operation. As is best shown in FIG. 3, the pins 32 and 39 and the opening 35 all extend in a direction parallel to the longitudinal axis of the bolt 20. The pins extend through the upper and lower surfaces of the lower cushion 33, substantially through the cushion.

An upper cushion 40 is shaped like lower cushion 33 and is made of the same material. This cushion has a center opening 42 that fits over kingpin 20, and only differs from cushion 33 in that it does not have a small opening. This cushion fits into the cup-shaped upper surface of the boss 37 of arm 18. The upper surface of the cushion 40 is designed to fit within the downwardly extending enclosure of upper cushion cup 43, which is formed by a flat circular plate 44 and the downwardly extending wall 45 extending around the periphery of the plate to form a cupped shape similar to lower cushion cup 27. In the center of the plate is an opening 46 to permit the cup to fit over the kingpin. The upper surface of the cup is flat and contacts the lower surface of a crossbar 47 which interconnects the two wheel support assemblies 19. The end of the crossbar has an opening 48 through which the kingpin passes. A nut 49, having a threaded opening 50, is adapted to be threaded on the upper portion of the kingpin, between the crossbar 47 and the boss 51 of the hanger bracket. The nut 49 has a shoulder 54 on its lower surface, this shoulder extending through the openings 48 and 46 of the crossbar 47 and cup 43, respectively, as shown in FIG. 3, which locks those three members together. The boss 51 has a downwardly extending tapered portion 53 which fits within the upper end of the nut 49 to complete the locking action of the assembly. This action is further improved by the addition of a vertical slot 55 in the boss. It should be noted that the threads of the kingpin 20, which are shown to be the same throughout, may differ at their upper and lower ends to accomodate the various members to which the kingpin is threaded. It is also possible to omit the threads in the areas where they are not required, such as where passing through the upper and lower cushions 33 and 40, and the arm 18.

The wheel support assembly and the truck frame are braced against the outer portion of hanger bracket 13 in order to control the movement of arm 18 about the axis of the axle 16; and provides a separate adjustment. The truck frame 14 includes a boss 60 which is rigidly mounted to the frame. This boss has a centrally threaded opening in which is inserted a screw 61 having a spherical upper end 62 which is seated within a socket 63 in the lower surface of the hanger bracket, the socket serving as a bearing for the spherical end to permit a pivoting relationship. The upper end of the screw is provided with flat surfaces 64 to permit rotation by a wrench or other tool. A nut 65 is also mounted on the screw to lock the screw into any adjusted position, the lower surface of the nut bearing against a lock washer 56, which bears against the flat upper surface of boss 60.

OPERATION OF THE DEVICE

The general arrangement of the wheel support assembly and the outer bracing assembly is quite similar to that described and shown in the above-referenced U.S. Pat. No. 2,510,722; in that patent the control of resilience which is accomplished by compressing the upper and lower cushions takes place by rotating the kingpin. However, at the same time it is necessary to loosen a jam nut designated in that patent by reference number 22, which is similar to nut 49 of the present application. In order to adjust the compression of the cushions according to that patent, it would be necessary to (1) loosen the jam nut, (2) rotate the kingpin, and (3) retighten the jam nut. This procedure could become cumbersome because of the frequency with which cushion compression must be varied by the skater. This is the principal method by which the skater controls the tilt, pivot, and "feel" of his skate, all of which must be controlled according to the type of action he demands for different types of skating. Increasing the compression of the cushions provides a firmer action control, which reduces the tilt or pivot of the wheel truck relative to the kingpin and the wheel support assembly. A specific example of the skater's art involves his need to skate in circles or "figure eights". If he wishes to make large diameter "figure eights", he need to compress the cushion and avoid smaller sub-curves. If he wishes to make small diameter "loop circles", he needs to reduce cushion compression.

The present device is much simpler to operate; it is only necessary for the skater to perform one step, namely rotation of the locking cap 22 clockwise to increase compression of the cushions, or counter-clockwise to reduce compression. The serrations 24 of the locking cap are deep enough to interlock with the serrations 30 of the lower cushion cup; yet shallow enough to allow the locking cap to be rotated relative to the cushion cup. The advantage of the pins 32 and 39 are now apparent; by insertion into the corresponding opening in the lower cushion, the pins serve to prevent rotation of the lower cushion cup as the locking cap is rotated. Although only one set of pins are shown, it should be understood that two or more sets of similar pins 32 and 39 and mating pins 35, may be provided and radially spaced from each other.

Rotation of the locking cap thus controls the cushion compression by means which are completely apart from the kingpin or any other part of the wheel support assembly. In particular, the kingpin and the nut 49, once adjusted to a preferable position, need not be touched. The locking cap then becomes, in effect, a fine adjustment.

This arrangement also permits the skater to use the serrations as an indexing arrangement; the skater quickly determines which position of the cap provides the necessary relative compression for his various maneuvers, and he can use the "clicks" of the serrations to re-index his compression by touch or by sight. Suppose, for example, the skater is making his small loop circles with the cap in a given position, and knows that he needs to increase compression by three click positions. He merely rotates the cap clockwise so that the serrations move three positions, or three-eighths of a turn (assuming eight serrations). When he wishes to repeat the small loop circles, he rotates the cap counter-clockwise by three click positions to the previous position. He thus has a simple means for repeated indexing, whereas in prior art devices such repeated indexing is not possible.

The locking cap 22 as illustrated may be rotated by means of a wrench or similar tool. However, it is contemplated that an integral lever may be made part of the cap, or a wing-type nut or similar device may be substituted, so that the cap may be rotated by hand.

The described embodiment is merely exemplary, and it is understood that variations are possible within the scope of the following claims.

We claim:

1. In a roller skate comprising a foot plate and a hanger bracket attached thereto, a truck frame having an axle-receiving part including an arm extending generally parallel to said bracket; a wheel support assembly secured to said hanger bracket and including a bolt extending approximately at right angles through said arm and into said bracket, and at least one polymeric compressible resilient member mounted on said bolt; the improvement comprising separate adjusting means mounted on said bolt for controlling the compression of said resilient member, said compressible resilient member comprising an upper cushion interposed between said arm and said bracket and a lower cushion below said arm, said wheel support assembly comprising an upper cushion cup partially enclosed and retaining said upper cushion against the upper surface of said arm and a lower cushion cup partially enclosing and retaining said lower cushion against the lower surface of said arm; said adjusting means comprising said lower cushion cup and a rotatable locking cap threadably disposed on said bolt adjacent to and interlocking with said lower cushion cup to selectively compress said cushions and to lock them into selected position in which said locking cap and said lower cushion cup have interengaging faces comprising radially extending serrations, a first set of serrations of one of said locking members being indented oppositely to a second set of serrations of the other locking member to effect interengagement between both sets of serrations, and means for preventing rotation of said lower cushion during rotation of said locking cap, said means comprising a first member mounted on said arm and a second member mounted on said lower cushion cup, both of said members interengaging said lower cushion to prevent said rotation, said first and second members of said rotation preventing means comprising a first elongated cylindrical pin mounted on the lower surface of said arm and a second elongated cylindrical pin mounted on the upper surface of said lower cushion cup, said pins extending in a direction parallel to the longitudinal axis of said bolt, said rotation preventing means further comprising at least one cylindrical longitudinally extending opening in said lower cushion also parallel to the longitudinal axis of said bolt, said pins fitting into said opening and extending through the upper and lower surfaces of said lower cushion and substantially therethrough.

2. In a roller skate according to claim 1 in which said adjusting means also includes indexing means for indicating relative compression of said resilient member.

3. In a roller skate according to claim 2 in which said indexing means may be observed by touch.

4. In a roller skate according to claim 2 in which some of said indexing means are located on the lower surface of said cap.

* * * * *